United States Patent [19]

Gentry

[11] 3,942,953

[45] Mar. 9, 1976

[54] FUME INCINERATOR AND SEAL STRUCTURE THEREFOR

[75] Inventor: Charles B. Gentry, Grand Rapids, Mich.

[73] Assignee: Granco Equipment, Inc., Grand Rapids, Mich.

[22] Filed: Sept. 24, 1973

[21] Appl. No.: 400,314

[52] U.S. Cl. ..... 23/277 C; 165/9; 110/8 A; 165/7

[51] Int. Cl.[2] ..... F23G 7/06

[58] Field of Search ..... 165/7–10; 23/277 C; 110/8 A

[56] References Cited

UNITED STATES PATENTS

| | | | |
|---|---|---|---|
| 2,469,758 | 5/1949 | Alcock | 165/9 |
| 3,209,813 | 10/1965 | Hryniszak | 165/9 |
| 3,509,834 | 5/1970 | Rosenberg et al. | 23/277 C X |
| 3,690,840 | 9/1972 | Volker | 23/277 C |

FOREIGN PATENTS OR APPLICATIONS

| | | | |
|---|---|---|---|
| 676,573 | 7/1952 | United Kingdom | 165/9 |
| 1,121,635 | 1/1962 | Germany | 165/10 |

*Primary Examiner*—Albert W. Davis, Jr.
*Attorney, Agent, or Firm*—McGarry & Waters

[57] ABSTRACT

A fume incinerator having a rotary heat exchanger with a novel seal structure therefor. A rotating rotary heat exchanger wheel is positioned in the mouth of a tubular incinerator having a closed end wall opposite to the rotary heat exchanger. A baffle extends from the heat exchanger wheel to a point spaced from the closed end of the incinerator so that the fume and air mixture, after passing through one side of the heat exchanger wheel, is passed through one side of the incinerator wherein it is heated to a temperature sufficient to oxidize the fumes in the mixture, passes around the end of the baffle to the other side of the incinerator and through the other side of the heat exchanger wheel. The fume and air mixture is preheated from the heat of combustion as it passes through the heat exchanger wheel. The heat exchanger wheel is axially tapered and a seal member surrounding the heat exchanger is likewise tapered in a complementary manner. The rotary heat exchanger wheel is adjustably mounted on its axis of rotation so that the gap between the circumferential surface of the wheel and the seal member is adjustable. The heat exchanger wheel is made from a thermally stable ceramic material and the seal member surrounding the heat exchanger wheel is made from a thermally stable ceramic material having temperature expansion characteristics similar to that of the heat exchanger wheel.

10 Claims, 5 Drawing Figures

FUME INCINERATOR AND SEAL STRUCTURE THEREFOR

BACKGROUND OF THE INVENTION

1. Field of the Invention

This invention relates to incinerators and rotary heat exchangers therefor. In one of its aspects, the invention relates to an incinerator for fumes and the like wherein the incinerator is in the form of a tubular chamber with a rotary heat exchanger at one end thereof to heat the incoming fume and air mixture with the heat from the products of combustion. In another of its aspects, the invention relates to a seal structure for a rotary heat exchanger for use, for example, in incinerators.

2. State of the Prior Art

Incineration of combustible fumes is a problem currently facing many industries such as lithography, smoke houses, paint shops, etc. It has been found that combustion of these fumes at the present time is the most effective way to eliminate the fumes from these industrial processes although the cost of fuel for such incineration has been considerable. Efforts have been made to more completely recoup the heat energy required to raise the fume and air mixture to incineration temperatures. For example, see U.S. Pat. No. 3,706,445 to Charles B. Gentry for FUME INCINERATOR, and U.S. Pat. No. 3,670,667 to William A. Phillips for INCINERATOR WITH EXTENDED HEAT EXCHANGE SURFACE.

It has been proposed to use a rotary heat exchanger to recover the heat from hot exhaust gases for preheating the fume containing gases which are to be incinerated. In such incinerators, the rotating heat exchanger wheel must be sealed in order to prevent appreciable fume containing gases from entering the exhaust without passing through the incinerator.

Rotary regenerators have been used for many years for recouperating heat from hot gases. In recent years, special ceramic materials have been developed for use in these rotary regenerators. The ceramic materials have a very low coefficient of expansion and find particular utility in the automotive field in connection with turbine engines. An example of such ceramic material is Cer-Vit material which is manufactured and sold by Owens-Illinois of Toledo, Ohio.

One of the problems with these rotary heat exchangers has been the inability to effectively seal the edges of the wheel without appreciable frictional resistance. One seal system is disclosed in U.S. Pat. No. 3,372,735 to Meijer. This patent discloses a rotary ceramic heat exchanger for hot gas engines wherein the ceramic heat exchanger wheel has a surrounding ceramic housing which is made from the same type of ceramic material. A gap seal is formed between the movable wheel and the housing. This type of heat exchanger requires precise machining of parts so that the gap forming the seal is very small.

Other rotary regenerators of the metallic type use rubbing seals as disclosed in the U.S. Pat. to Wahlbeck No. 3,389,745. Such seals are subject to wear and develop frictional resistance to rotation of the heat exchanger.

SUMMARY OF THE INVENTION

According to the invention, a fume incinerator has a rotary regenerator which can recover up to 85% of the heat required for incineration. The rotary regenerator is sealed very tightly by an annular a gap seal so that frictional drag on the regenerator is minimized. Yet, substantially none of the fume and air mixture leaks to the exhaust. The gap seal is adjustable so that the seal structure is very precise yet relatively inexpensive.

The incinerator according to the invention is generally tubular shaped, closed at one end and open at the opposite end. An axial flow rotary heat exchanger of a ceramic material is mounted rotatably in the open end of the tubular incinerator with the axis of rotation aligned with the axis of the tubular incinerator. A baffle axially divides the tubular incinerator into two sides and extends from the rotary heat exchanger to a point spaced from the closed end of the incinerator, leaving a passageway between one side of the incinerator and the other. The baffle thus divides the incinerator into a combustion chamber and a residence chamber with a passageway therebetween at the closed end of the incinerator. The baffle terminates at a floating refractory seal at the rotary heat exchanger so that incoming fumes passing through the heat exchanger can be restricted to the combustion chamber of the incinerator.

A burner is provided within the combustion chamber of the incinerator for raising the temperature of the fume and air mixture to an oxidation temperature for the fumes. The fume and air mixture is directed through one side of the heat exchanger and into the combustion chamber for incineration. The combustion gases pass around the end of the baffle and into the residence chamber and thereafter through the other side of the rotary heat exchanger. Thus, the heat of combustion is transferred by the rotary heat exchanger to the incoming fume and air mixture for preheating the same.

The shape of the incinerator provides a smooth and even flow of the gases through the rotary heat exchanger and provides a very efficient structure. The reversal of the gases within the incinerator has a turbulating effect on the gases which is desirable for thorough mixing of the gases to assist in substantially complete incineration of the fumes therein.

Further according to the invention, the rotary heat exchanger is comprised of a ceramic wheel having a circumferential surface thereof axially tapered. A surrounding seal structure is made from a thermally stable material such as bubble alumina, and has a seal surface which is tapered in a complementary fashion to the outer tapered surface of the ceramic heat exchanger wheel.

The wheel is mounted for rotation about an axis which is the center of rotation of the tapered circumferential surface of the wheel. Further, the wheel is mounted for axial movement so that the gap seal formed between the heat exchanger wheel and the surrounding seal member is adjustable for precise definition of the gap seal.

Desirably, the seal surface of the surrounding seal member is provided with at least one blocked annular groove extending at least partially around the seal surface. These annular grooves provide pockets of reduced pressure for inhibiting the flow of gases along the gap seal area.

BRIEF DESCRIPTION OF THE DRAWINGS

The invention will now be described with reference to the accompanying drawings in which.

DESCRIPTION OF THE PREFERRED EMBODIMENT

Figure 1:
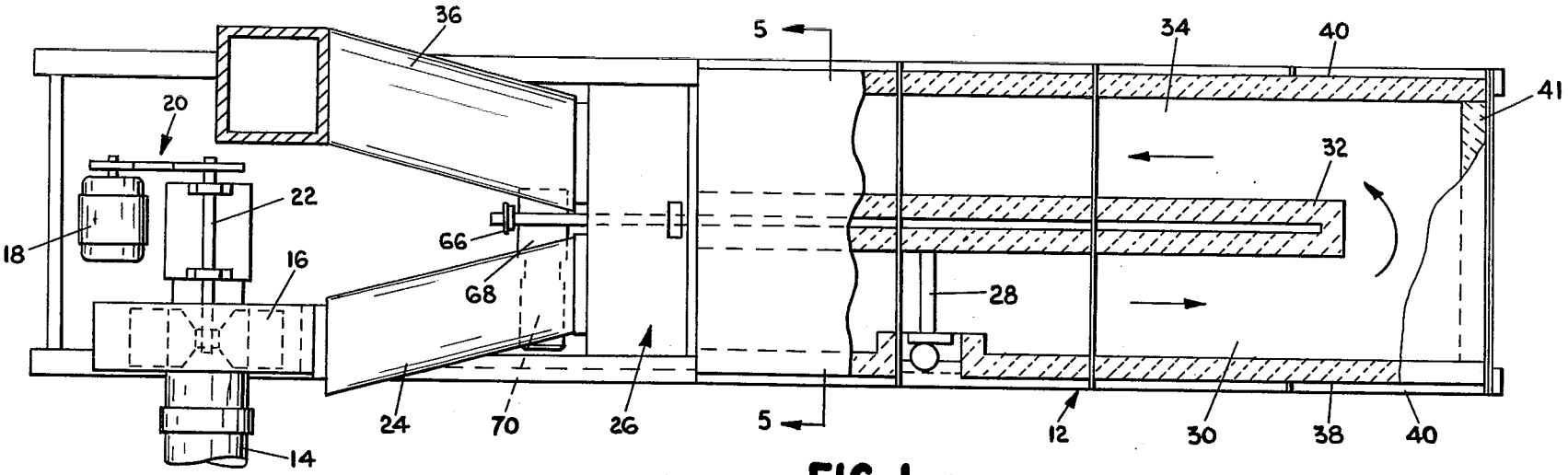
FIG. 1 is a plan view partially broken away of an incinerator according to the invention.
Figure 5:
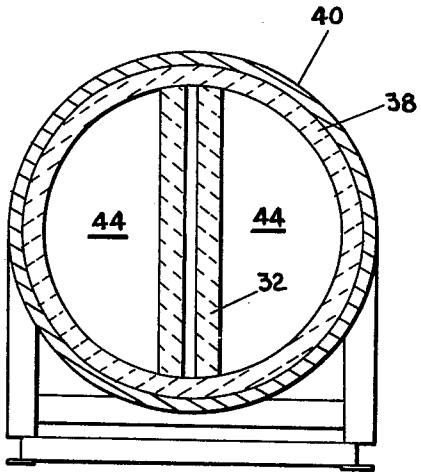
FIG. 5 is a view taken along lines 5—5 of FIG. 1.

Referring now to the drawings, and to FIGS. 1 and 5 in particular, there is shown an incinerator 12 which is supplied with a fume and air mixture through a fume duct 14. The fume and air mixture may come from a drying oven for lithographed sheets, for example, may come from a smoke house, or any other type of industrial process in which combustible fumes are generated.

A fan 16 draws the fume and air mixture from the fume duct 14 and forces the mixture through an intake duct 24. The fan 16 is of conventional structure and is driven by a motor 18 through a pulley assembly 20 and a drive shaft 22. The fume and air mixture is forced from the intake duct 24 through a rotary regenerative heat exchanger designated generally by the numeral 26 and into one side of the tubular incinerator 12. As seen in FIG. 5, the tubular incinerator is formed by an outer annular metal wall 40 and an inner refractory wall 38. An end wall 41 seals the end of the tubular incinerator 12. A vertical baffle which can be provided with an air-cooled central portion, divides the interior of the tubular incinerator 12 into a combustion chamber 30 and a residence chamber 34. A burner 28 which, desirably, is a gas-fired grid type burner, is provided in the combustion side of the tubular incinerator 12 to heat the fume and air mixture entering the combustion chamber 30 to a temperature sufficient for oxidation of the fumes in the fume and air mixture. An example of a suitable burner is disclosed in the U.S. Pat. No. 3,524,632 to Davies. The combusted gases, after passing around the end of the baffle 32 and through the residence chamber 34, pass through the other side of the rotary heat exchanger 26 and through an exhaust duct 36 through which they are exhausted to the atmosphere.

Figure 2:
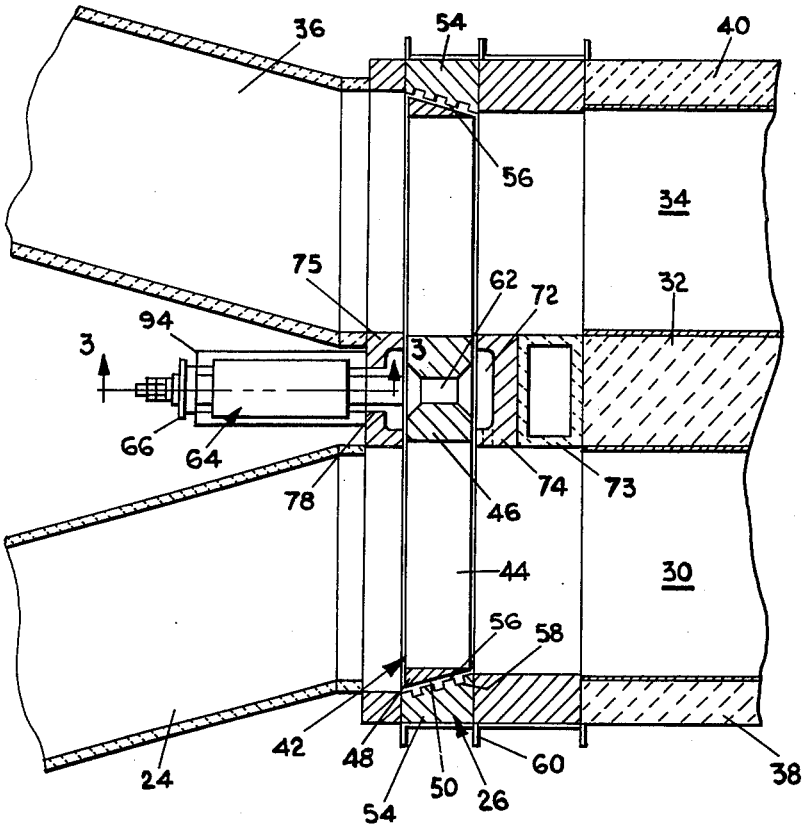
FIG. 2 is an enlarged plan view in section of the heat exchanger and housing structure shown in FIG. 1.

Reference is now made to FIG. 2 which shows an enlarged sectional plan view of the rotary heat exchanger structure 26. The heat exchanger comprises a ceramic heat exchanger wheel 42 having a plurality of axially arranged ducts for passage of gases therethrough. Rotary regenerator wheels of the ceramic type are well known and desirably are made from a thermally stable ceramic material such as the Cer-Vit material manufactured by Owens-Illinois of Toledo, Ohio. The heat exchanger wheel has a large annular portion 44 containing the axial ducts through which the fume and air mixture passes on one side of the structure and through which the incinerated gases pass on the other side of the structure. The heat exchanger wheel 42 further has a solid ceramic core 46 at a central portion, through which core 46 of the wheel 42 is firmly mounted to a support shaft 62. The preferred mounting structure for the wheel 42 is to clamp the core between a pair of flared flanges under spring compression. More complete disclosure of such mounting is found in commonly assigned copending patent application of William A. Phillips entitled INCINERATOR AND HEAT EXCHANGER MOUNTING STRUCTURE THEREFOR.

The support shaft 62 for the heat exchanger wheel 42 is mounted on and journaled in bearing supports 64. The support shaft 62 is rotatably powered through sprocket 66 which in turn is rotated through a chain (not shown) by a motor 70 having a gear box 68 (see FIG. 1).

An annular seal member 54 is mounted around the periphery of the heat exchanger wheel 42 and has a complementary tapered inner surface 56 which tapers inwardly and toward the tubular incinerator 12. The seal member 54 is desirably made from a thermally stable refractory material such as glass rock bubble alumina which has thermal expansion characteristics similar to that of the heat exchanger wheel 42 and is softer than the wheel 42. The tapered surface 56 follows the taper of the incinerator wheel outer surface 50 so that a close gap seal is provided between the tapered surface 50 of the heat exchanger wheel and the complementary tapered surface 56 of the annular seal member 54. Desirably a plurality of annular cavities 58 are provided in the seal member 54 along the tapered surface 56. These annular cavities provide expansion chambers for trapping the gases in the gap seal area between the seal member 54 and the rotary heat exchanger wheel 42. These annular cavities 58 are desirably blocked by means (not shown) so that the gases cannot pass around the seal member 54 between the intake and exhaust portions thereof. The annular cavities 58 improve the seal capabilities between the rotary heat exchanger and the annular seal member 54 by providing areas of low pressure along the gap seal. Thus, gases passing between the heat exchanger wheel 42 and the seal member 54 will be subject to a plurality of low pressure changes, whereby the pressure differential between one side of the wheel and the other side of the wheel along the gap seal area will be effectively diminished and the resistance to flow will be increased.

A ceramic channel 74 forms a purge chamber 72 on the "hot" side (the right side as viewed in FIG. 2) of the heat exchanger wheel 42 for receiving purged gases which are forced through the wheel as the wheel turns from the fume and air side of the exchanger to the hot exhaust side of the chamber. The purge chamber 72 is mounted vertically in a central portion of the heat exchanger wheel 42 and secured to a hollow conduit 73 of ceramic material at the end of the vertical baffle 32. The channel 74 desirably is also made from a thermally stable refractory material, such as bubble alumina, and forms a seal between the combustion chamber 30 and the residence chamber 34. Openings 77 are provided between the purge channel 72 and the combustion chamber 30 so that the purged gases are passed to the combustion chamber 30. Cooling air is supplied to the hollow conduit 73 to maintain the position of the refractory channel 70 fixed with respect to the heat exchanger wheel 42. The baffle 32 is fixed at the hollow conduit 73 and thus any thermal expansion of the baffle 32 takes place away from the hollow conduit 73.

At the cool side (left side as viewed in FIG. 2) of the rotary heat exchanger wheel, another refractory channel 75 is provided for supply of cooling air for the wheel mounting structure and for supply of purge air. An opening 78 extends through the refractory channel 75 for penetration of the mounting shaft 62.

Figure 4:
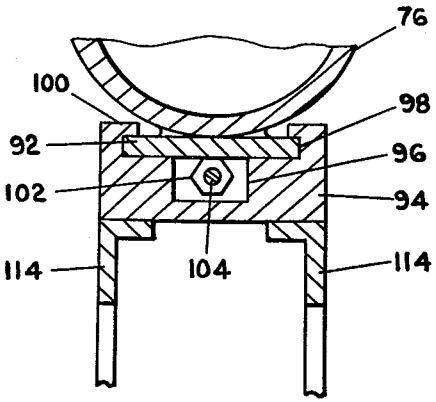
FIG. 4 is a partial sectional view taken along lines 4—4 of FIG. 3.
Figure 3:
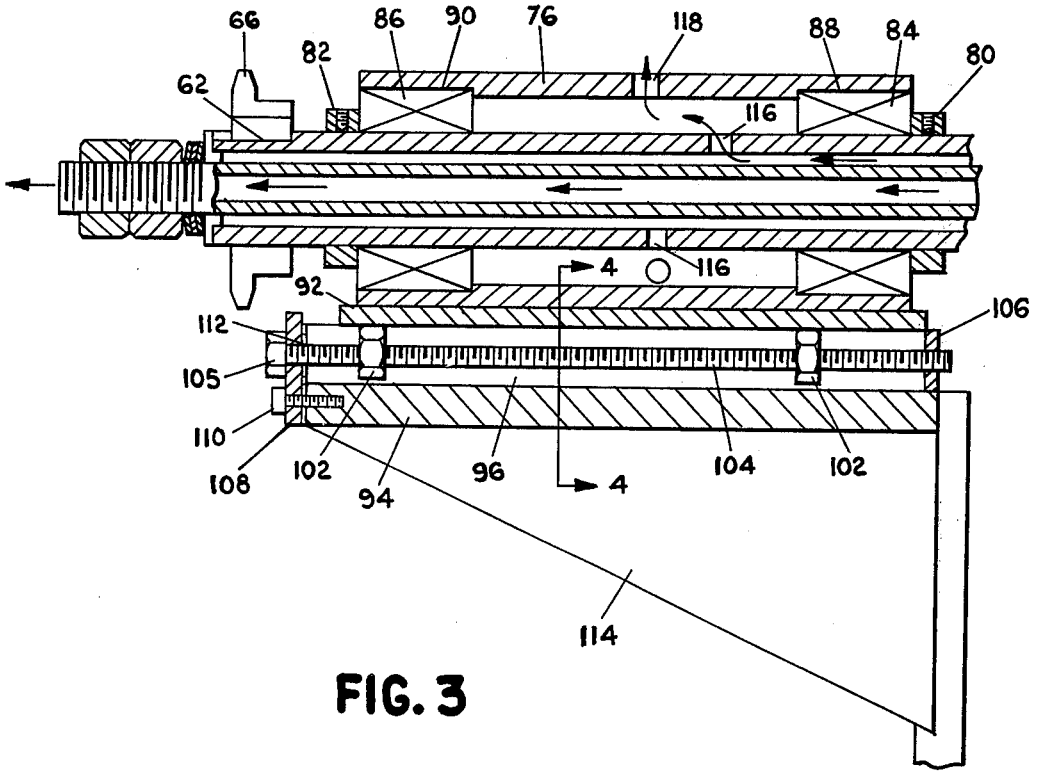
FIG. 3 is a partial sectional view taken along lines 3—3 of FIG. 2.

Reference is now made specifically to FIG. 3 and to FIG. 4 for a more detailed discussion of the mounting assembly for the shaft 62 and the heat exchanger wheel 52. The bearing support 64 is formed from an outer cylindrical housing 76 which encases bearings 84 and 86. Notches 88 and 90 position the bearings 84 and 86 respectively within the cylindrical housing 76. Rings 80 and 82 are secured to the support shaft 62 as by set screws, for example, so as to retain the bearings 86 in a given position on the shaft 62. A mounting plate 92 is secured to the bottom of the cylindrical housing 76 and is slidably received within an upper glide channel 98 of a slideblock 94. A pair of nuts 102 are secured to the bottom of the mounting plate 92 and slide freely within a bottom channel 96 of the slideblock 94. The slideblock 94 has a pair of inwardly directed retaining flanges 100 at an upper portion of the upper glide channel 98 for retaining the top of the mounting plate 92 wherein. A threaded rod 104 having a nut 105 at one end threadably engages the nuts 102 and is journaled in a rear plate 106 and a front plate 108. A washer 112 is provided behind the front plate 108 on the threaded rod 104 to axially retain the threaded rod 104 in the front plate 108. A bolt 110 secures the front plate 108 to a bottom portion of the slideblock 94. A pair of angle supports 114 are secured to the heat exchanger casing structure or other suitable fixed members and are rigidly attached to the bottom of the slideblock 94 for rigidly securing the same.

As seen in FIG. 3, the support shaft 62 is made from two annular shafts through which cooling air can be circulated. Holes 116 can be provided in the outer of the two shafts for circulation of cooling air through the cylindrical housing 76 and openings 118 can be provided in the cylindrical housing 76 for escape of cooling air therefrom.

OPERATION

The fume and air mixture is drawn by fan 16 through the fume duct 14 and passes through the intake duct 24, through one side of the heat exchanger wheel 42 and into the combustion chamber 30, passing through burner 28. The fume and air mixture is heated first by heat exchange with the rotary heat exchanger wheel 42 and thereafter by the burner 28 to the oxidation temperature of the fumes. The incoming fume and air mixture to the heat exchanger wheel 42 may be in the temperature range of 350°–400°F. The heat exchanger wheel 42 raises the temperature of the fume and air mixture to about 1000°–1100°F and the burner 28 further heats the mixture to about 1400°F at which the fumes will be oxidized with the air in the mixture. The oxidation can continue to take place as the fume and air mixture passes around the end of the baffle 32 and passes through the residence chamber 34. As the fume and air mixture passes around the end of the baffle 32, it is turbulated, thereby increasing the mixing of the fumes with the air so that more oxidation will be likely to take place. As the oxidized gaseous mixture passes through the other side of the rotary heat exchanger wheel 42, it heats the wheel and thereafter is exhausted through exhaust duct 36. In the event that the fume mixture contains resins and other materials which may deposit on the heat exchanger wheel 42, these resins will be burned off the wheel by the hot gases at the exhaust side of the heat exchanger wheel. Thus, when the heat exchanger wheel is used in an incinerator for recuperating heat of incineration, the wheel becoems self-cleaning in that any oxidizable material deposited on the wheel by the fume containing gases is oxidized by the hot combustion gases.

During the rotation of the rotary heat exchanger wheel, a gap seal is formed between the annular outer portion 48 thereof and the annular seal member 54. By proper machining of the surface 50 of the wheel 42 and proper machining of the seal surface 56, the gap seal can be reduced to less than 1/100 of an inch. The gap disitance of the seal can be adjusted by moving the wheel axially with respect to the annular seal member 54. This axial movement of the wheel 42 is accomplished by turning the nut 105 on the end of the threaded rod 104. In the event that the surfaces 50 and 56 of the heat exchanger wheel 42 and the seal member 54, respectively, are not exactly complementary, the ceramic wheel can be used to grind away high spots on the surface 56 of the seal member 54 so that the surfaces are exactly complementary. Thus, the axial adjustability of the heat exchanger wheel 42 coupled with the tapered surfaces of the heat exchanger wheel 42 and the annular seal member 54 provide for an extremely small gap between the rotating wheel and the seal member 54. Such a gap is desirably less than 1/100 inch.

The incinerator described above has exceptionally good qualities of recuperation of the heat of incineration, for example, up to 85%. The rotary heat exchanger used with the tubular incinerator structure provides even flow of gases between the incinerator and the heat exchange structure thereby minimizing the pressure drop through the heat exchanger. Substantial turbulence results from reversal of the gases within the combustion chamber of the incinerator so that mixing of the gases is promoted for substantially complete oxidation of the fumes. The adjustable axially tapered wheel provides an exceptionally effective gap seal between the rotating wheel and the annular seal member 54. Further, the close seal is a relatively frictionless seal so that the heat exchanger wheel rotates without frictional drag from seals. Still further, the close gap seal avoids the establishment of thermal stresses on the heat exchanger wheel due to rubbing seals which are cooler than the heat exchanger wheel. The cooler rubbing or contact seals tend to cool the wheel at contact areas to set up undesirable thermal stresses in the ceramic wheel.

Reasonable variation and modification are possible within the scope of the foregoing disclosure, the drawings, and the appended claims, without departing from the spirit of the invention.

The embodiments of the invention in which an exclusive property or privilege is claimed are defined as follows:

1. In a fume incinerator including a rotary heat exchanger for recuperating heat from hot gases wherein a ceramic heat exchanger wheel having a plurality of passages extending axially therethrough is mounted for rotation about a central axis and a seal member surrounds said heat exchanger wheel in sealed relationship thereto, the improvement which comprises:

said heat exchanger wheel having an axially tapered circumferential surface which has said central axis of said heat exchange wheel as its center of rotation, and said seal member including a tapered surface of a size and shape complementary to said tapered circumferential surface of said heat exchanger wheel, whereby a gap seal is formed between said complementary surfaces on said heat exchange wheel and said seal member.

2. A fume incincerator according to claim 1 wherein said seal member is made of a refractory material having a temperature expansion characteristic similar to that of said heat exchanger wheel.

3. A fume incinerator according to claim 2 wherein said refractory material is bubble alumina.

4. A fume incinerator according to claim 2 wherein said complementary surfaces include at least one annular groove extending at least partially around said surface of said seal member to provide a pocket of reduced pressure for inhibiting the flow of gases axially along said gap seal.

5. A fume incinerator according to claim 4 and further comprising means for axially adjusting the position of said heat exchanger wheel to adjust the gap of said seal.

6. A fume incinerator according to claim 2 and further comprising means for axially adjusting the position of said heat exchanger wheel to adjust the gap of said seal.

7. A fume incinerator according to claim 1 wherein said incinerator comprises a tubular conduit closed at one end and open at the opposite end thereof, said ceramic heat exchanger wheel being positioned in the open end of said tubular conduit and substantially completely filling said opening; a baffle extending axially in the tubular conduit from the rotary heat exchanger to a point spaced from the closed end of said tubular conduit and positioned diametrically therein, said baffle dividing said tubular conduit into a combustion chamber and a residence chamber with a passageway therebetween at the closed end of the conduit; burner means in said combustion chamber for raising the temperature of the gas to an oxidation temperature of fumes therein; whereby a fume and air mixture can be directed through one side of the rotary heat exchanger and into the combustion chamber wherein the temperature thereof is raised to an oxidation temperature of the fumes, the combustion products can pass around the end of the baffle into the residence chamber and through another side of the heat exchanger to supply heat thereto.

8. An incinerator according to claim 7 wherein said annular seal member is made from a refractory material.

9. An incinerator according to claim 7 and further comprising means mounting said rotary heat exchanger for axial movement to adjust the gap seal between said rotary heat exchanger and said seal member.

10. A fume incinerator according to claim 1 wherein said heat exchanger wheel is mounted on a shaft which extends through the central axis of said wheel.

* * * * *